US007947349B2

(12) United States Patent
Schlüsselbauer

(10) Patent No.: US 7,947,349 B2
(45) Date of Patent: May 24, 2011

(54) MOULDED PIECE FOR A SHAFT BOTTOM

(76) Inventor: Johann Schlüsselbauer, Altenhof am Hausruck (AT)

( * ) Notice: Subject to any disclaimer, the term of this patent is extended or adjusted under 35 U.S.C. 154(b) by 397 days.

(21) Appl. No.: 11/332,449

(22) Filed: Jan. 13, 2006

(65) Prior Publication Data

US 2006/0159876 A1 Jul. 20, 2006

(51) Int. Cl.

| | |
|---|---|
| ***B65D 39/00*** | (2006.01) |
| ***E02D 29/00*** | (2006.01) |
| ***B22D 19/00*** | (2006.01) |
| ***B22C 9/24*** | (2006.01) |
| ***B28B 7/28*** | (2006.01) |

(52) U.S. Cl. ..... 428/36.5; 249/11; 249/83; 249/145; 249/184

(58) Field of Classification Search ..... 428/34.1, 428/36.5; 249/11, 83, 145, 184
See application file for complete search history.

(56) References Cited

U.S. PATENT DOCUMENTS

| | | | | |
|---|---|---|---|---|
| 4,177,229 | A * | 12/1979 | Moore | 264/40.5 |
| 4,565,347 | A | 1/1986 | Ditcher | 249/83 |
| 4,867,411 | A * | 9/1989 | Dorsey et al. | 249/11 |
| 5,067,298 | A * | 11/1991 | Petersen | 52/742.14 |
| 5,402,592 | A * | 4/1995 | Caveney et al. | 40/665 |
| 2004/0157945 | A1* | 8/2004 | Barber | 521/155 |
| 2004/0226904 | A1* | 11/2004 | Schroeder | 215/6 |

FOREIGN PATENT DOCUMENTS

| | | | |
|---|---|---|---|
| AT | 653/2003 | | 4/2003 |
| CA | 2 522 196 | | 3/2004 |
| CZ | 288 238 | | 7/1996 |
| DE | 3611394 | A1 | 10/1987 |
| DE | 43 42 518 | A1 | 6/1995 |
| DE | 295 12 165 | | 12/1995 |
| DE | 198 15 544 | | 10/1999 |
| GB | 2 300 663 | | 11/1996 |
| GB | 2374645 | A * | 10/2002 |

OTHER PUBLICATIONS

"Innovations from BAUMA 3004, Custom made prebenched maintenance hole monobases produced in one single casting operating," Bentowek und Fertigteil Technik, Bauverlag Gütersloh, DE, Bd. Nr. 70, Nr. 5, 2004, pp. 88 to 90.

* cited by examiner

*Primary Examiner* — Rena L Dye
*Assistant Examiner* — James Yager
(74) *Attorney, Agent, or Firm* — Ostrolenk Faber LLP

(57) ABSTRACT

In order to save material and/or for an easy assembly in a mould bottom of a bottom mould, a moulded piece forming a negative mould of at least a part of a chute of a shaft bottom which moulded piece is formed from a material forming a dead core and, optionally being assembled with at least one further moulded piece, forms the negative mould of a chute of a shaft bottom in the form of a moulded body, wherein the moulded piece(s) is (are) designed for being placed onto a mould bottom of a bottom mould for a shaft bottom and has (have) linear and/or an arcuate longitudinal extension, is characterized in that the moulded piece has at least one hollow space open toward the base which can be placed onto the mould bottom of the bottom mould and is designed as basically closed on the end faces lying opposite each other in the longitudinal extension of the moulded piece.

17 Claims, 3 Drawing Sheets

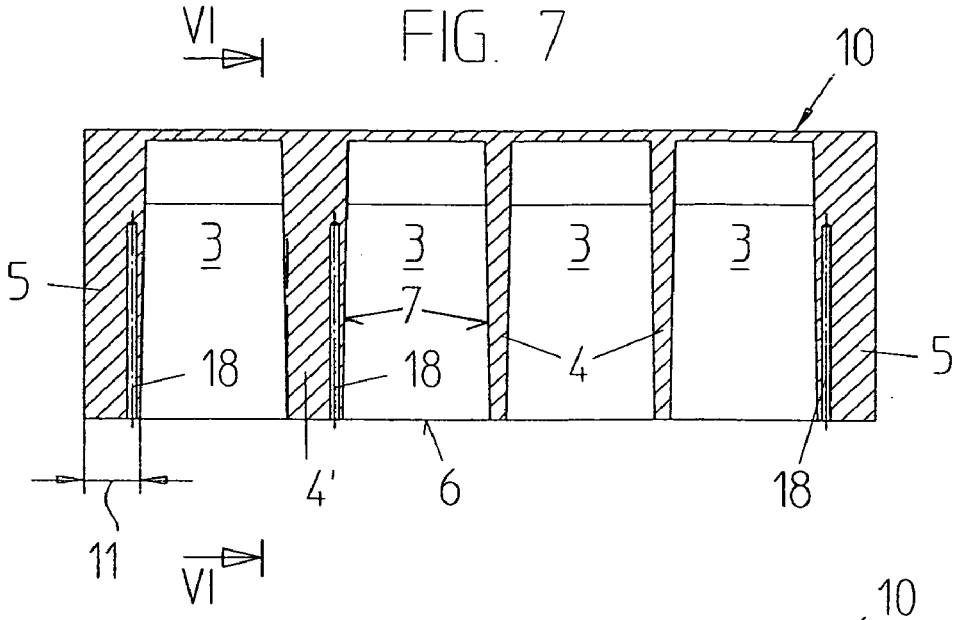
FIG. 7
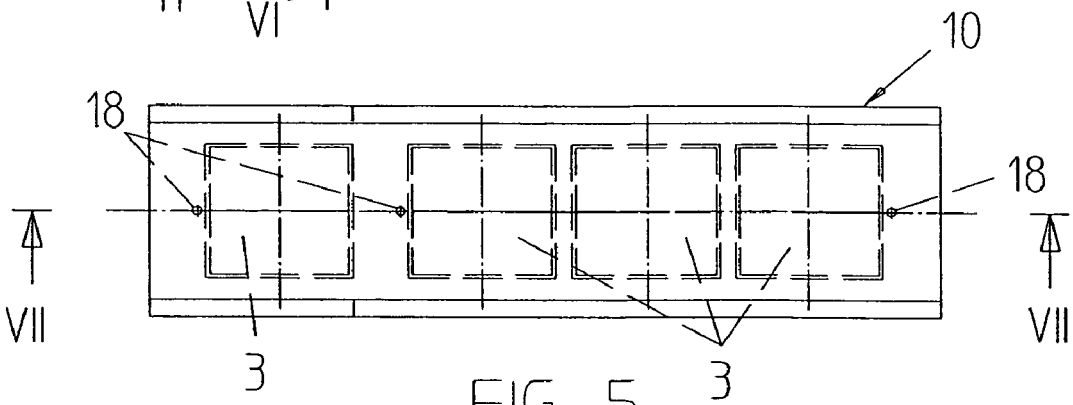
FIG. 5
FIG. 6
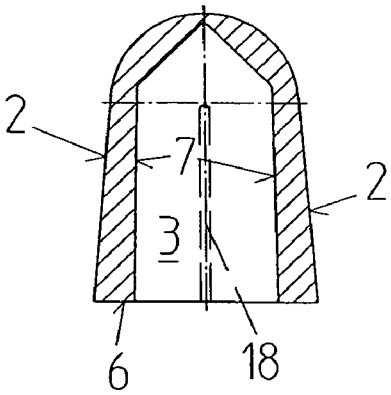
FIG. 7A
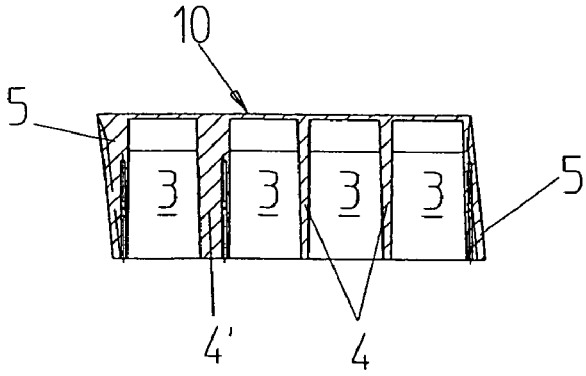

MOULDED PIECE FOR A SHAFT BOTTOM

BACKGROUND OF THE INVENTION

The invention relates to a moulded piece forming a negative mould of at least a part of a chute of a shaft bottom which moulded piece is formed from a material forming a dead core and, optionally being assembled with at least one further moulded piece, forms the negative mould of a chute of a shaft bottom in the form of a moulded body, wherein the moulded piece(s) is (are) designed for being placed onto a mould bottom of a bottom mould for a shaft bottom and has (have) a linear and/or an arcuate longitudinal extension, as well as to a mounting appliance for the production of the moulded piece.

Shaft bottoms form the lower impervious closure of normally vertical shafts which permit sewage systems to have access to canals such as sewers and underground pipeline systems. Such shafts are often located at intersecting points of canals or pipeline systems, respectively, i.e. at canal branchings or outlets and inlets, respectively, of subsidiary canals etc. The shaft bottoms forming the lower closure of such shafts are pot-shaped formations having a comparatively thick-walled impervious bottom and a mostly cylindrical side wall in which connection ports for the pipes and/or canals are formed. Canals open at the top and usually having a semicircular or roughly U-shaped cross-section, which are referred to as chutes, run in the shaft bottom between the respective connection ports provided in the side wall of a shaft bottom. In order to guarantee a congestion-free flow of the fluids which often are contaminated by substantial amounts of lumpy solids, the chutes have a certain gradient and the shaft bottom has a tread with a small inclination, also referred to as a berm.

Although the shafts are composed of standardized individual rings, the shaft bottoms are uniquely shaped components which differ in terms of the positioning of the connection ports functioning as inflows and outflows, the cross-sectional shape of the chutes and the pipes to be connected thereto. Moreover, only high-quality fluid-tight concrete may be used for the manufacture of lower shaft parts and in particular of the chutes thereof.

From DE 36 11 394 A1 it is known for the production of a shaft bottom to arrange a mould bottom, the top side of which is shaped according to the negative mould of the chute, in a bottom mould which has a mantle placed on a base plate. Such a mould bottom is usable again and again—after sufficient hardening of the concrete, it is removed from the mantle, is cleaned and can then be available for reuse. A disadvantage is the very complicated manufacture of such a mould bottom; for the production of uniquely shaped shaft bottoms, the same number of costly mould bottoms would have to be provided, i.e. a separate mould bottom would have to be provided for almost every shaft bottom. Since this is far too expensive, the device known from this document is used only for a small number of shaft bottoms, for instance, if a chute crosses the shaft bottom in a straight line or bent by 90° for example.

For shaft bottoms the chutes of which are to be connected to two canals running in different directions or which exhibit other special features, for cost reasons, shaft bottoms with a level bottom have been produced and the chute is manufactured on the level bottom by introducing concrete manually and forming the chute by hand. This kind of manual labour is tedious, since it is necessary to bend forward into the shaft bottom over the side wall thereof. Furthermore, the chute has to be formed with great accuracy so that both the gradient and the position of the secondary arms of the canal correspond to the local conditions of the canal system or of the pipeline system, respectively. This manual production of a chute requires qualified personnel and, for that reason, is expensive. Moreover, it also involves a substantial expenditure of time, and furthermore the quality of the manually formed concrete is not comparable with the quality of a shaft bottom that has been produced mechanically.

From DE 43 42 518 A1, it is known to form the chute by inserting a clay shell element which remains in the shaft bottom after the completion thereof, forming the bottom of the chute. Also in this case it is difficult to produce chutes to be designed individually, particularly since a separate clay shell element would have to be prefabricated for each chute, which likewise involves high expenses.

According to a further suggestion concerning the manufacture of a shaft bottom, prefabricated moulded plastic parts are used with a negative mould corresponding to the chute, whereby a separate moulded part has to be manufactured for each individual chute, which moulded part is to be fixed to the mould bottom. Said moulded parts are produced as plastic shells for each individual chute according to the respective course of the chute, involving relatively high expenses, and remain as so-called dead moulds in the finished chute. A disadvantage of this process, besides the high costs for the moulded parts designed as high-quality plastic shells, is the manufacture necessarily taking place at external suppliers, whereby the entire logistics for the mechanical production of lower shaft parts becomes rather more complicated.

It is internally known (Austrian patent application A 653/2003) for the production of a shaft bottom to provide moulded pieces for the formation of a moulded body, which moulded pieces are manufactured from a material withstanding the pressure of the concrete such as from a foamed material, in particular a rigid-foamed synthetic material or a thermoplastic synthetic material such as EPS, respectively. Said moulded pieces suitably have a linear or an arcuate longitudinal extension, with the cross-section corresponding to the cross-section of the chute and with the height of the cross-section of the moulded pieces optionally being dimensioned larger than the height of the cross-section of the chute.

Such prefabricated moulded pieces ensure the mechanical production of shaft bottoms comprising chutes of predetermined cross-sections without elaborate moulding. It is merely necessary to provide for a seamless transition between the individual moulded pieces. For this purpose, possible gaps between the moulded pieces or between the moulded pieces and the mould bottom, respectively, or around the clearance pieces, respectively, can be covered and/or filled up by a joint filler.

Due to the thermoplastic properties of the foamed materials that are used, the profiled pieces can be trimmed arbitrarily not only on the face side but also in the area of the attachment surface facing the tread surface of the mould bottom by means of a resistance wire in a comparatively simple manner. The advance of the resistance wire can be controlled mechanically depending on the shape that is required in each case.

SUMMARY OF THE INVENTION

The invention aims at developing further these internally known moulded pieces to the effect that the moulded pieces can be produced in a material-saving way and can be assembled easily into a moulded body and can also be provided simply and safely on a mould bottom, without resulting in a detachment, i.e. a floating, of the moulded body during the casting of the concrete.

Said object is achieved with a moulded piece of the initially described kind in that the moulded piece has at least one hollow space open toward the base which can be placed onto the mould bottom of the bottom mould and is designed as basically closed on the end faces lying opposite each other in the longitudinal extension of the moulded piece. The hollow space enables simple removal of the moulded pieces by breaking out the end faces, whereupon the lateral faces forming the chute are movable toward the centre of the hollow space and the moulded piece can be removed easily from the hardened concrete.

From U.S. Pat. No. 4,867,411 A, moulded pieces are known which are designed in a hollow manner. Said moulded pieces are reusable again and again and are manufactured from solid plastic. For the purpose of forming a chute, they are arranged one after the other and screwed together. They serve for being inserted in a prefabricated shaft bottom which is already closed at one end, with the hollow spaces open toward one side being oriented upwards, whereupon conrete is poured into the shaft bottom. Such a shaft bottom is thus formed from two parts, namely the prefabricated shaft bottom into which concrete is then poured by means of the moulded bodies, with the chute being formed.

According to the invention, simple manufacture of a moulded piece is ensured if the hollow space extends taperingly into the interior of the moulded body, starting from the base.

Sufficient stability of the moulded piece—even if said piece has to be shortened according to the local conditions of the shaft bottom - is created in that several hollow spaces lying one behind the other in the lengthwise direction of the moulded piece are provided, which hollow spaces are separated from each other by partition walls extending basically down to the base.

A particularly suitable embodiment of a moulded piece is characterized in that it extends with its longitudinal extension across a quarter circle and that three hollow spaces disposed one behind the other in a lengthwise direction are arranged in an equally distributed manner.

For rectilinear moulded pieces, it has proven to be suitable if four hollow spaces lying one behind the other in a lengthwise direction are located within the moulded piece, preferably with three hollow spaces being in closer vicinity to each other and one hollow space being separated from the three closely adjacent hollow spaces by a slightly thicker partition wall.

A simple orientation guide for assembling several moulded pieces into one moulded body or for providing connections, respectively, is created in that a central marking in the form of a V-shaped recess or a V-shaped elevation is provided on a moulded piece at the arcuate peak thereof.

In order to be able to keep in stock prefabricated moulded bodies in a space-saving way, these pieces being stacked without resulting in deformations of the moulded bodies, a moulded piece is designed such that the base of the moulded piece is provided with an arcuate recess extending across the entire longitudinal extension of a moulded piece, with the curvature of the arcuate recess corresponding to the curvature of the arcuate peak of the moulded piece.

In order to achieve a smooth concrete surface, the moulded pieces suitably have a closed-cell configuration on the outer surface, which, for example in case of a rigid-foamed synthetic material, can be achieved in that the moulds for the production of the moulded pieces are polished or provided with a specific vaporization, respectively.

A simple possibility of attaching a moulded piece or a moulded body, respectively, consisting of two or several moulded pieces to a mould bottom of a bottom mould is created if a permanent magnet arranged roughly in alignment with the base is mounted in at least one hollow space, with the permanent magnet preferably fastened to a holding device which is fixed via a fixing means to a side wall of the moulded piece.

A particularly simple assembly of two or several moulded pieces can be achieved by using a mounting plate which is characterized in that the mounting plate has a diameter which is slightly smaller than the diameter of a mould bottom of the negative mould of the shaft bottom, wherein the mounting plate is provided with recesses equally distributed across at least a part of the circumference and close to the circumference, into which bolts can be inserted which can be inserted into recesses of the end and/or partition walls of a moulded piece, with the recesses of the moulded piece starting from the base thereof.

For the purpose of centering the moulded piece on the outgoing side of the shaft bottom to be cast, a bolt, which can be inserted into a recess of an end and/or partition wall of a moulded piece, is rigidly arranged at a point of the circumference of the mounting plate.

Preferably, the recesses of the mounting plate are designed as oblong holes arranged in a radial direction.

BRIEF DESCRIPTION OF THE DRAWINGS

The invention is illustrated in greater detail below by way of several exemplary embodiments illustrated in the drawing, wherein

FIG. 5 shows the top view of a rectilinear moulded piece,

FIG. 6 shows a section taken along Line VI-VI of FIG. 7 which shows a section taken along Line VII-VII of FIG. 5.

DESCRIPTION OF A PREFERRED EMBODIMENT

Figure 1:
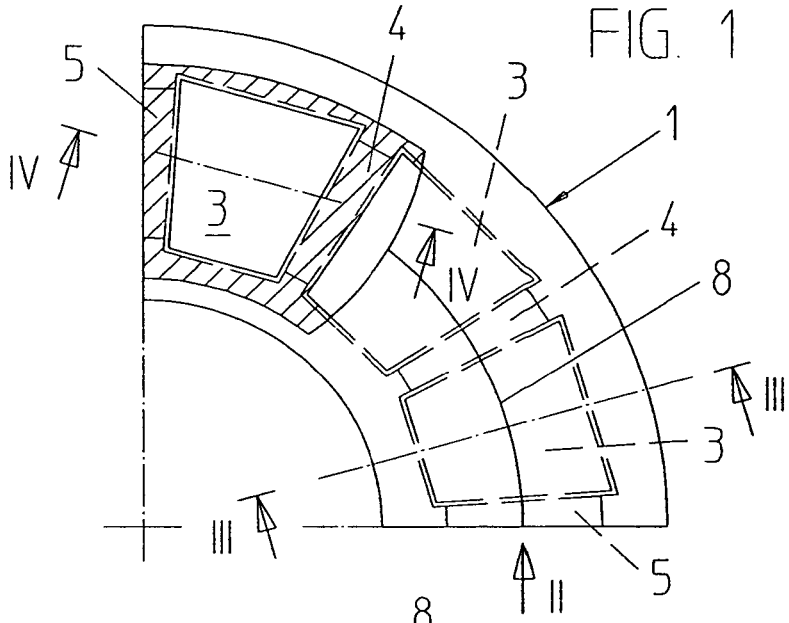
FIG. 1 is a partially sectioned top view of a moulded piece in a curved embodiment.
Figure 2:
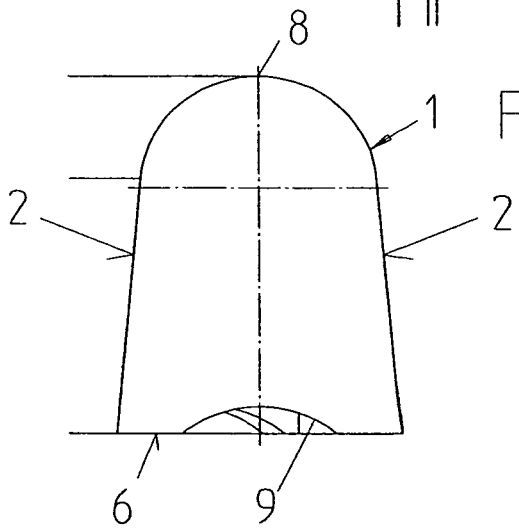
FIG. 2 is a front view in the direction of Arrow II and FIGS. 3 and 4 illustrate sections taken along Lines III-III and IV-IV.
Figure 3:
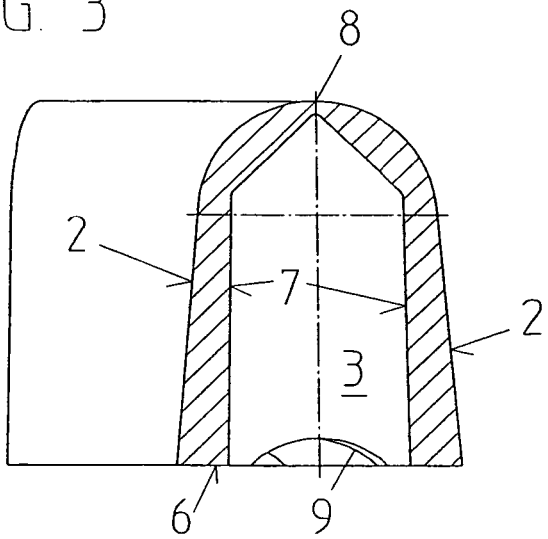
Figure 4:
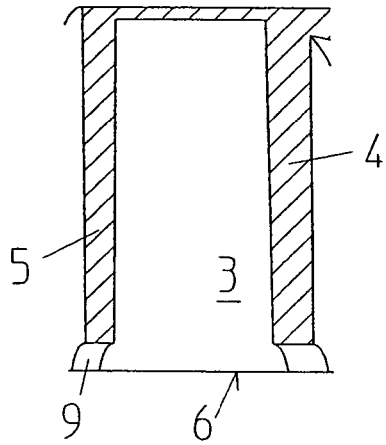

The moulded piece 1 illustrated in FIG. 1, made from a foamed material, in particular a rigid-foamed synthetic material or a thermoplastic synthetic material such as EPS, respectively, extends across a quarter circle and has a roughly U-shaped cross-section, with the legs of the sides 2 that form the U diverging toward the open end of the U. The moulded piece 1 has three hollow spaces 3 arranged one behind the other in the longitudinal extension of the moulded piece 1, between which partition walls 4 are provided, with the ends of the moulded piece 1 closed by end walls 5. Said hollow spaces 3 are open toward the base 6 of the moulded piece 1 and have side walls 7 which also diverge toward the open side so that the manufacture, in particular the removal from a manufacturing mould, is simplified.

At the peak of the moulded piece 1, there is a marking 8, preferably designed as a groove or a small elevation, whereby a central attachment of connections to the moulded piece 1 is facilitated. A further marking may also be provided vertically at the exterior of the moulded piece 1 in order to allow that a possible projection on the face side can be cut off precisely.

On the base 6, the moulded piece 1 is provided with arcuate recesses 9 which have the same curvature as the peak area of the moulded piece 1 so that the moulded pieces 1 can be stacked on top of each other without the formation of pressure marks, which might cause a deformation of a moulded piece 1.

The moulded pieces 1 have a closed-cell configuration at the exterior which comes into contact with concrete. This may be effected, for instance, by polishing or vaporizing the manufacturing moulds if the moulded pieces are formed from a rigid-foamed synthetic material or the like.

The moulded piece 10 illustrated in FIGS. 5 to 7 has a linear longitudinal extension and is also provided with hollow spaces 3 arranged one behind the other which extend upwardly, starting from the base 6 of the moulded piece 10, i.e. in the direction of the arcuate peak area of the U-shaped cross-section of the moulded piece 10, also expanding outwardly in a conical fashion. The end parts of this moulded piece 10 are equipped with end walls 5 which have a larger thickness 11 than the partition walls 4 so that arcuate trimming or trimming with regard to a gradient to be maintained, respectively, as illustrated for instance for the end walls 5 in FIG. 7A, becomes possible. In order to allow a better utilization of the prefabricated moulded pieces 10, in the linear moulded piece 10, the second partition wall 4' is also designed thicker so that said partition wall can also serve as an end wall if the first hollow space 3 is separated.

Figure 8:
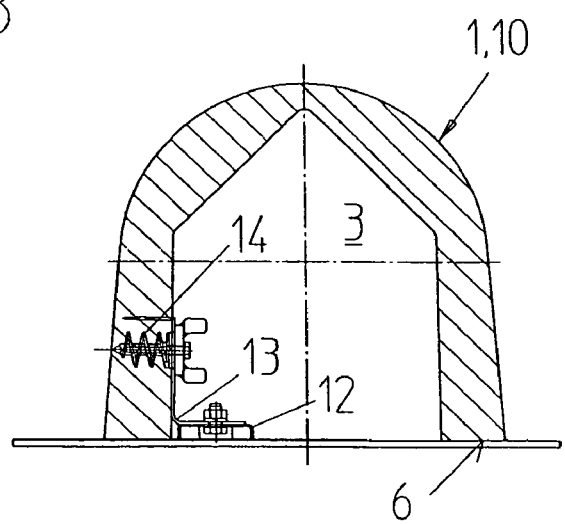
FIG. 8 shows, in section, a detail of a moulded piece.

In FIG. 8, which illustrates a cross-section through a moulded piece, it is shown how a permanent magnet 12 can be fixed to the moulded piece in the hollow space 3 thereof by means of a corner bracket 13 and a specially designed screw 14. Said permanent magnet 12 reliably retains the moulded piece on a magnetic mould bottom of a bottom mould so that the moulded piece cannot float during the casting of the concrete.

Figure 9:
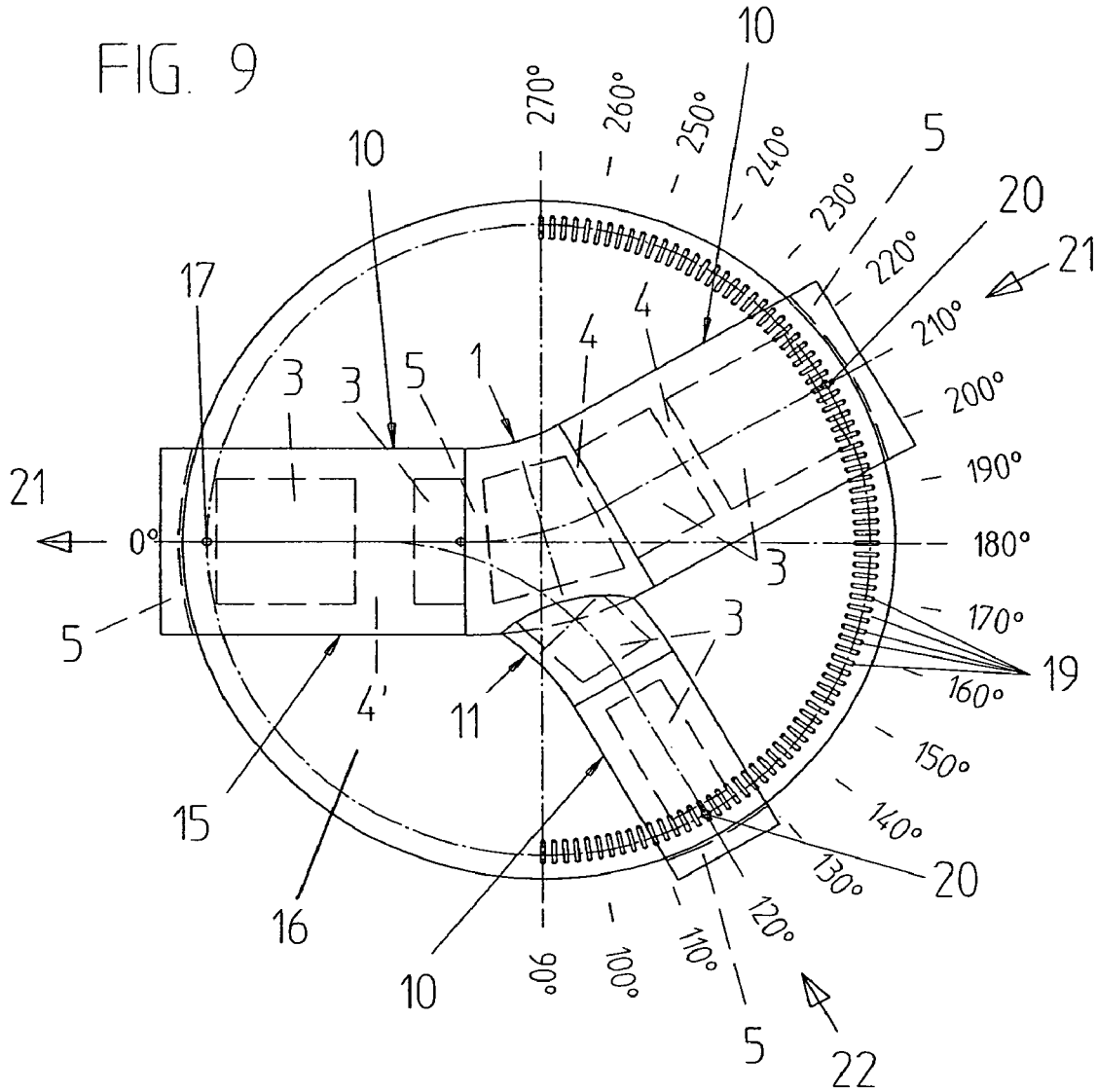
FIG. 9 illustrates a moulded body composed of several moulded pieces which is placed on top of a mounting plate.

The assembly of several moulded pieces 1 and/or 10 into one moulded body 15 is facilitated by a mounting plate 16, as illustrated in FIG. 9. In one place, said mounting plate has a fixedly arranged bolt 17 which can be inserted into a corresponding recess 18 (cf. FIG. 7) of a moulded piece 1—for example having a diameter of 12 mm—if said moulded piece 1 is placed onto the mounting plate 16. Furthermore, the mounting plate 16 is provided with recesses 19 at least across an angle of 180° close to the circumference, into which bolts 20 can be inserted which are provided in moulded pieces, i.e. which have been inserted into recesses 18 of the moulded pieces 1 and 10, respectively, so that the further moulded piece 1 or 10, respectively, can assume a precise position relative to the moulded piece arranged on the bolt 17, which was previously firmly arranged on the mounting plate. After the formation of the moulded body thus formed on the mounting plate, the circular cutting of the ends of the moulded pieces, which ends project beyond the mounting plate, can be started.

In detail, the following procedure is followed for the formation of a chute comprising a main chute and a secondary chute: The bolt 17 fixedly mounted to the outgoing side serves for centering the outlet of a main chute (indicated by Arrows 21). The bolts 20, which suitably have a rectangular shoulder on the bottom side, are to be arranged, according to the required angles, in the oblong holes 19 on the inflow or supply sides, respectively. At first, the main chute 21, which has already been stuck together, is installed. Subsequently, the secondary chute (indicated by Arrow 22) is affixed to the main chute 21. For a correct angular adjustment, at first the bolt 20 is positioned, the secondary chute (which has already been adapted according to the main chute) is centered on the bolt and pushed toward the main chute (the bolt is movable in the oblong hole 19 in the lengthwise direction thereof). The chute thus assembled can now be cut into a round shape.

After circular cutting, the moulded body 15 (cf. FIG. 9) stuck together from the moulded pieces 1 and/or 10 can be equipped with the above-described permanent magnets 12. For this purpose, the corner bracket 13 on an inside 7 of a hollow space 3 is first pressed into the wall (e.g. made of polystyrene) and subsequently is fastened with the specially designed screw 14. In order that the magnet 12 does neither protrude nor is set back on the bottom side, it makes sense to resort to a nonmagnetic ledge for pressing the corner bracket 13 (with the magnet 12 already mounted) into the polystyrene. Subsequently, the moulded body 1 or 10, respectively, is placed on the mould bottom of a bottom mould, aligning itself with the bolt attached to the outgoing side. The chute is fixed to the inflows and outflows by means of holding strips which prevent floating.

The invention claimed is:

1. A moulded piece forming a negative mould of at least a part of a chute of a shaft bottom, the moulded piece being formed from:

a base and at least two hollow spaces open toward the base;

wherein the moulded piece has a linear and/or an arcuate longitudinal extent and has a first end face lying opposite to a second end face in the longitudinal extent of the moulded piece, the first end face comprising a first end wall and the second end face comprising a second end wall;

the moulded piece is a single integrally formed continuous unbroken structure formed from a thermoplastic synthetic material, wherein the thermoplastic synthetic material is continuous and unbroken throughout the structure, so as to facilitate trimming using wire of at least one of the first end wall or the second end wall; and a partition wall extending to the base, the partition wall positioned transverse to the longitudinal extent of the moulded piece and configured to separate a first hollow space of the at least two hollow spaces from a second hollow space of the at least two hollow spaces.

2. The moulded piece according to claim 1, wherein the at least two hollow spaces extend taperingly into an interior of a body of the moulded piece starting from the base.

3. The moulded piece according to claim 1, wherein the at least two hollow spaces are positioned one behind the other in the longitudinal extension of the moulded piece.

4. The moulded piece according to claim 1, wherein the moulded piece has an arcuate longitudinal extension, the longitudinal extension extends across a quarter circle, and the at least two hollow spaces comprise three hollow spaces lying one behind the other along the longitudinal extension such that a distance between a first and a second hollow space of the three hollow spaces is equal to a distance between the second and a third hollow space of the three hollow spaces.

5. The moulded piece according to claim 1, wherein the moulded piece has a linear longitudinal extension, and the at least two hollow spaces comprise four hollow spaces lying one behind the other.

6. The moulded piece according to claim 1, wherein the moulded piece is formed with a central marking in the form of a V-shaped recess or a V-shaped elevation formed at an arcuate peak of the moulded piece.

7. The moulded piece according to claim 1, wherein the base of the moulded piece is formed with an arcuate recess extending across an entire longitudinal extension of the moulded piece such that curvature of the arcuate recess corresponds to an arcuate peak of the moulded piece.

8. The moulded piece according to claim 1, wherein an outer surface of the moulded piece has a closed-cell configuration.

9. The moulded piece according to claim 1, further comprising a permanent magnet aligned with the base and mounted in the at least one hollow space.

10. The moulded piece according to claim 9, wherein the permanent magnet is fastened to a holding device fixed via a fixing means to a side wall of the moulded piece.

11. The moulded piece according to claim 5, wherein three hollow spaces of the four hollow spaces are positioned with less distance between the three hollow spaces than a distance between the first hollow space of the three hollow spaces and a fourth hollow space of the four hollow spaces, the fourth hollow space being adjacent the first hollow space; and the moulded piece is also formed from a second partition wall transverse to the longitudinal extent of the moulded piece and configured to separate the second hollow space from a third hollow space of the three hollow spaces, and wherein the first hollow space and the fourth hollow space are separated by a thick partition wall which is thicker than the first partition wall and the second partition wall.

12. In combination, the moulded piece according to claim 1 and at least one a second moulded piece, wherein the moulded piece is configured to be assembled together with the at least one second moulded piece to form a moulded body forming the negative mould of the chute of the shaft bottom.

13. The moulded piece according to claim 12, wherein the second moulded piece comprises at least two hollow spaces separated by a partition wall.

14. The moulded piece according to claim 1, wherein the moulded piece is formed from a foamed material.

15. The moulded piece according to claim 1, wherein the moulded piece is formed from EPS.

16. The moulded piece according to claim 1, wherein a first hollow space of the at least two hollow spaces is arranged behind a second hollow space of the at least two hollow spaces in the linear and/or arcuate longitudinal extension of the moulded piece.

17. The moulded piece according to claim 1, wherein the partition wall obstructs completely the hollow first space from the second hollow space.

* * * * *